US008944253B2

(12) United States Patent
Ward

(10) Patent No.: US 8,944,253 B2
(45) Date of Patent: Feb. 3, 2015

(54) MARINE MICROPLASTIC REMOVAL TOOL

(71) Applicant: Marc Ward, Seaside, OR (US)

(72) Inventor: Marc Ward, Seaside, OR (US)

( * ) Notice: Subject to any disclaimer, the term of this patent is extended or adjusted under 35 U.S.C. 154(b) by 0 days.

(21) Appl. No.: 14/086,175

(22) Filed: Nov. 21, 2013

(65) Prior Publication Data

US 2014/0138288 A1 May 22, 2014

Related U.S. Application Data

(60) Provisional application No. 61/728,874, filed on Nov. 21, 2012.

(51) Int. Cl.

| | |
|---|---|
| ***B07B 1/49*** | (2006.01) |
| ***B03C 7/02*** | (2006.01) |
| ***B07B 1/02*** | (2006.01) |
| ***B03C 7/00*** | (2006.01) |

(52) U.S. Cl.

CPC ... *B03C 7/02* (2013.01); *B07B 1/02* (2013.01); *B03C 7/006* (2013.01)

USPC ..... 209/417

(58) Field of Classification Search

CPC ..... B07B 1/02; B07B 1/46; B03C 1/0332; A47J 43/22; A47J 36/20

USPC ..... 209/235, 417, 420

See application file for complete search history.

(56) References Cited

U.S. PATENT DOCUMENTS

| | | | | |
|---|---|---|---|---|
| 5,622,266 | A * | 4/1997 | Curtis | 209/235 |
| 8,684,186 | B2 * | 4/2014 | Westgard | 209/370 |
| 8,813,968 | B1 * | 8/2014 | Mandeville et al. | 209/281 |
| 2002/0144935 | A1 * | 10/2002 | Tims | 209/235 |

* cited by examiner

*Primary Examiner* — David H Bollinger

(74) *Attorney, Agent, or Firm* — Daniel Boudwin; Global Intellectual Property Agency LLC

(57) ABSTRACT

A microplastic particle removal tool is provided that comprises an elongated mesh screen supported by a pair of opposing pole members. The mesh screen comprises a polymer coated, fine mesh that is adapted to sift microplastic affected sand and remove the microplastic particles therefrom during cleanup activities. The pole members are elongated members wrapped in a layer of padding material and fastened to the ends of the mesh screen. The poles support the mesh screen while sifting and are utilized to condense the mesh screen therearound when the device is not in use. During use, the mesh screen is placed in a horizontal condition while microplastic affected sand is deposited thereonto. A pair of users supports the handle ends of the pole members to sift the affected sand and thereby remove the microplastic particles therefrom via electrostatic attraction. The collected particles are removed from the screen thereafter and discarded.

11 Claims, 4 Drawing Sheets

FIG. 4
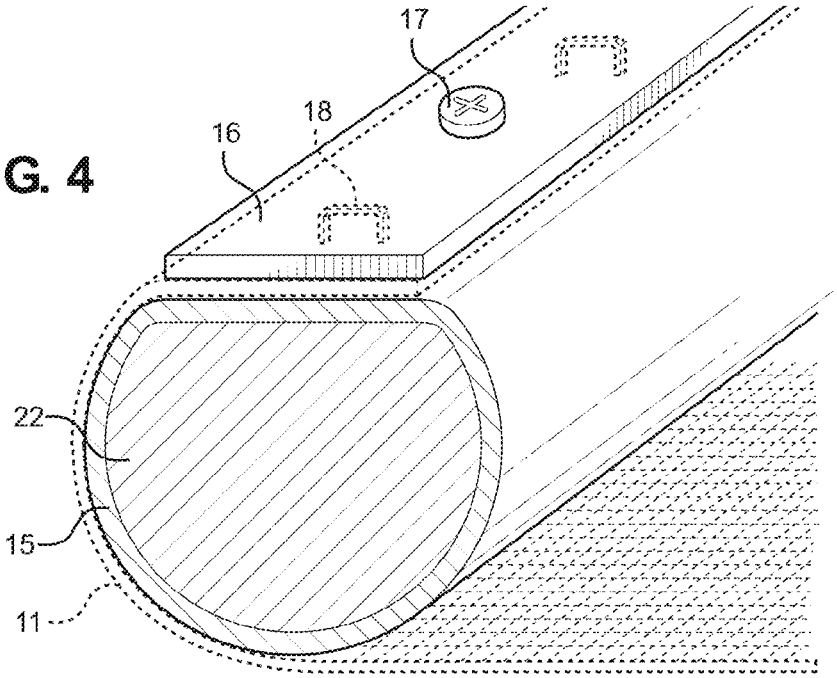
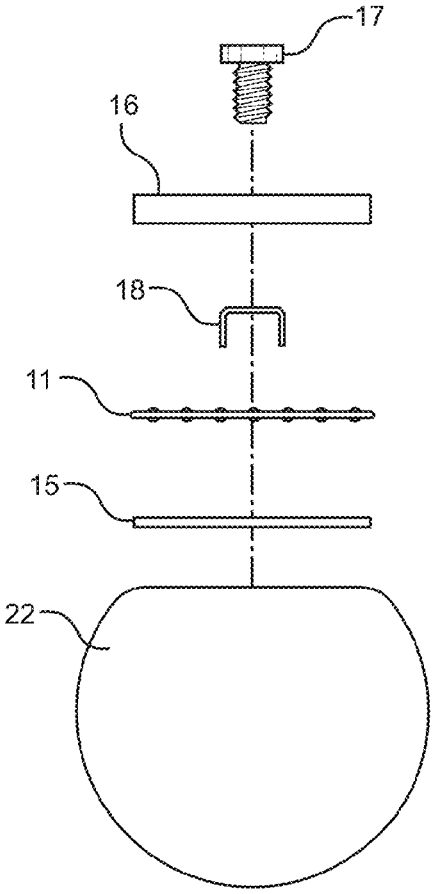
FIG. 5

MARINE MICROPLASTIC REMOVAL TOOL

CROSS REFERENCE TO RELATED APPLICATION

This application claims the benefit of U.S. Provisional Application No. 61/728,874 filed on Nov. 21, 2012. The above identified patent application is herein incorporated by reference in its entirety to provide continuity of disclosure.

BACKGROUND OF THE INVENTION

1. Field of the Invention

The present invention relates to hand tools for sifting and separating articles from sand. More specifically, the present invention pertains to a marine microplastic particle removal tool for use along beaches and shorelines for removing deposited microplastics therealong. The present invention provides a deployable mesh screen that utilizes electrostatic attraction to filter microplastic material from sifted sand.

Marine microplastics are a major environmental issue for beachfront property and coastal areas. Microplastics are minute plastic particles that are a product of environmental pollution created by discarded plastic products and different industries. Primary microplastics are particles that are generally less than a millimeter and are a product of various manufacturing industries, while secondary microplastics similarly sized particles derived from larger plastic product waste and textile fibers in the marine environment. These particles are not readily biodegradable and float with the ocean tides, generally depositing along shore lines and leaving visible bands of microplastic deposits therealong as the tide changes from high to low. As the tide recedes, the band of microplastic deposits becomes visible and is unsightly, not to mention environmentally unhealthy and potentially dangerous to wildlife and human alike.

The deposit of microplastics along beaches, aside from having an ecological impact, has a significant economic impact on local businesses and property owners therealong. Ocean resorts and hotels must maintain their property for guests, keeping up the appearance of the beach for continued use and for aesthetic reasons. Therefore the burden of cleanup of these microplastic deposits shifts to the local businesses and property owners, which can be both incredibly costly and time consuming. Different techniques are deployed, including both manual and mechanized removal of whole swathes of beach sand to remove the miniscule particles therefrom.

The present invention relates to a manual microplastics removal tool that has been proven particularly useful for sifting through sand and removing microplastic material contained therein. Specifically, the present invention relates to a hand tool that comprises an elongated wire mesh material secured between a first and second pole member. The wire mesh comprises a fine mesh size and a coating of polyurethane thereover such that as the beach sand is sifted, the microplastics become statically charged and attracted to the mesh. Sand affected by the microplastic deposits is shoveled onto the wire mesh, whereafter the sand is sifted, allowing the sand to pass through the wire mesh while capturing large quantities of the microplastics thereagainst. The assembly can then be wiped clean of the charged microplastics, wherein the same are deposited into a receptacle and disposed of. The tool allows users to quickly separate the microplastics from the sand without removing large quantities of the beach sand from the area and without resorting to larger, mechanized means of removal.

2. Description of the Prior Art

Methods have been disclosed in the prior art that relate to removal of marine microplastic particles from both marine environments and shorelines. These include the use of mostly mechanized devices that require considerable expense on the part of the property owner or the local authorities in charge of the cleanup activities. The present invention relates to a manual tool that requires a first and second user to operate. A thin layer of sand is skimmed from the beach along the band of microplastic particles that have washed ashore as a result of the tides. The sand is sifted using a fine mesh screen, whereby the sand is free to pass therethrough while the microplastics cling to the mesh screen as a result of electrostatic attraction. The tool is readily deployed and stowed, and does not require great expense on the part of the user.

The prior art methods of cleanup involve the use of heavy machinery or laborious procedures for removing the affected sand. The present invention has been shown as a useful tool that fulfills a long felt need in the art for improving the ability of one to react to microplastic waste deposits along a shoreline without great expense. It is submitted that the present invention substantially diverges in design elements from the prior art, and consequently it is clear that there is a need in the art for an improvement to existing microplastic removal tools and methods. In this regard the instant invention substantially fulfills these needs.

SUMMARY OF THE INVENTION

In view of the foregoing disadvantages inherent in the known types of microplastic cleanup and removal tools now present in the prior art, the present invention provides a new hand tool that can be utilized for providing convenience of beachfront owners and cleanup crews when removing deposited microplastic particles from beach sand.

It is therefore an object of the present invention to provide a new and improved microplastics removal tool that has all of the advantages of the prior art and none of the disadvantages.

It is another object of the present invention to provide a microplastics removal tool that is particularly suited for separating microplastic particles from within granular sand, and specifically beach sand.

Another object of the present invention is to provide a microplastics removal tool that does not involve the use of any electrical power or mechanized devices for the removal of microplastics waste along beaches.

Yet another object of the present invention is to provide a microplastics removal tool that is readily deployed between a pair of users, wherein a single pair of users can remove a significant area of affected shoreline in a short amount of time and at minimal expense to the property owner.

Another object of the present invention is to provide a microplastics removal tool that contemplates a polymer plastic coated mesh screen having a mesh opening suitable to allow granular sand to pass therethrough while being fine enough to contact the microplastic material within the sand to attract and secure the same thereto during the sifting procedure.

Another object of the present invention is to provide a microplastics removal tool that is lightweight, manually operated and can readily be stored between uses.

A final object of the present invention is to provide a microplastics removal tool that is suitable for personal or commercial use, wherein the device may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 4 shows an alternative construction of the microplastic removal tool of the present invention.

FIG. 5 shows an exploded view of the components of the alternative construction of the microplastic removal tool of the present invention.

DETAILED DESCRIPTION OF THE INVENTION

Figure 1:
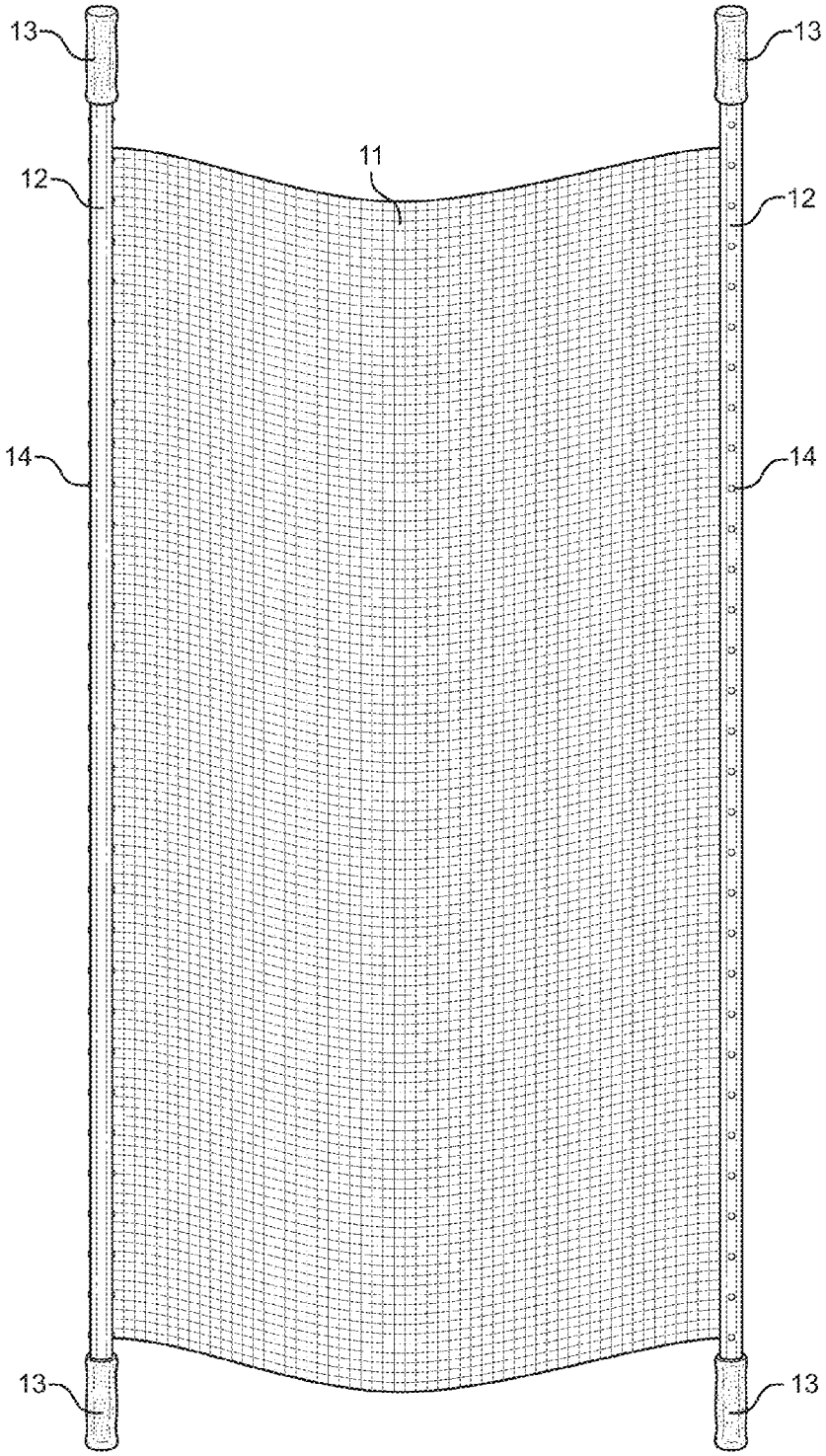
FIG. 1 shows a view of the microplastic removal tool of the present invention in an open state.

Reference is made herein to the attached drawings. Like reference numerals are used throughout the drawings to depict like or similar elements of the microplastic removal tool. For the purposes of presenting a brief and clear description of the present invention, the preferred embodiment will be discussed as used for removing microplastic particles from sand in a sifting operation. The figures are intended for representative purposes only and should not be considered to be limiting in any respect.

Referring now to FIG. 1, there is shown a view of the microplastic removal tool of the present invention in an open and deployed state. The device comprises a hand tool adapted for use by a pair of users along opposing sides of the device, wherein a sifting process is utilized to separate microplastic particles from affected sand. In use, the tool separates microplastic particles and fragments of plastic material from the sand, wherein the recent occurrence of accumulation and deposit of these particles along different beaches has become a real cause for concern. The particles are a direct result of certain manufacturing processes, where minute industrial byproducts or fragments of larger waste products are eventually put into the marine environment. Because of the plastic compounds these particles are composed of, the particles do not readily decompose over time and instead coalesce and eventually become deposited along beaches and shorelines. It is not uncommon for bands of microplastic particle deposits to be visible in highly affected areas, particularly as the tide recedes. The hand tool of the present invention is provided as a manual means of separating the deposited microplastics from the sand substrate upon which the microplastics have come to rest.

The tool comprises an elongated length of screen mesh 11 that comprises a fine wire mesh material having a plurality of apertures therethrough sized to allow granular sand to communicate thereacross when sand is placed thereon and sifted. The screen mesh 11 comprises a first and second end that is secured to a first and second pole member 12. The pole members 12 comprise elongated members having a handle ends 13 and a length that exceeds the length of each screen mesh end. The handle ends 13 act as user handles for a pair of users to grasp the pole members 12 by their ends and support the mesh screen 11 therebetween. The handle ends 13 are preferably covered by a handle grip material for improved purchase thereof and for comfort while in use.

The mesh screen 11 of the tool is comprised of a wire screen material that has a polymer plastic coating thereover. The preferred density of the mesh is an aperture size on the order of 0.7 millimeters. The exact size of the mesh screen apertures may vary depending on the type of sand and type of microplastics being sifted (i.e. larger or smaller aperture size), falling within the scope of providing a means of allowing sand to communicate across the mesh screen while separating microplastic material therefrom. The microplastic particles cling to the mesh screen 11 using electrostatic attraction, whereby the particles develop a charge while being sifted on the mesh screen and are rubbed against the polymer coating of the mesh screen 11. The sifting operation charges the microplastic particles while allowing the sand to fall therethrough and back onto the beach surface, while the particles become attracted to the mesh screen 11 and cling themselves thereto for subsequent removal and disposal.

Figure 2:
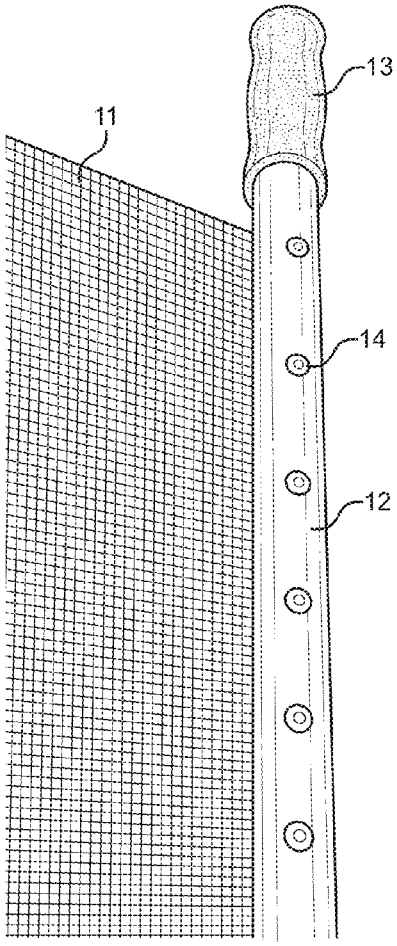
FIG. 2 shows a view of the pole member of the present invention a preferred means of securing the mesh screen thereto.

Referring to FIGS. 1 and 2, the connection between the pole members 12 and the mesh screen 11 is visible. The preferred embodiment of the present invention contemplates hollow, lightweight pole members 12 covered by a layer of padding tape or wrapping material that adds thickness to the pole members 12 and adds a layer of low stiffness material between the mesh screen ends and their connection with the pole members 12. This connection is preferably a fastener 14 connection that spans the length of the mesh screen end length and secures the end to the pole members. By placing a layer of material between the pole members 12 and the fasteners 14, the stress on the mesh screen 11 at the fastener locations is reduced. Load is placed on these locations when the mesh screen 11 is tensioned and when sand is placed thereon during the sifting process. This layer of wrapping material reduces the stress and reduces there likelihood of mesh screen failure at the fastener 14 locations. The wrapping material, however, is considered an option within the simpler attachment which involves simply an unwrapped pole member 12 and a direct fastener connection with the mesh screen 11 ends. The wrapping material has merely been shown as highly effective at reducing pull through and bearing failures at these locations.

Figure 3:
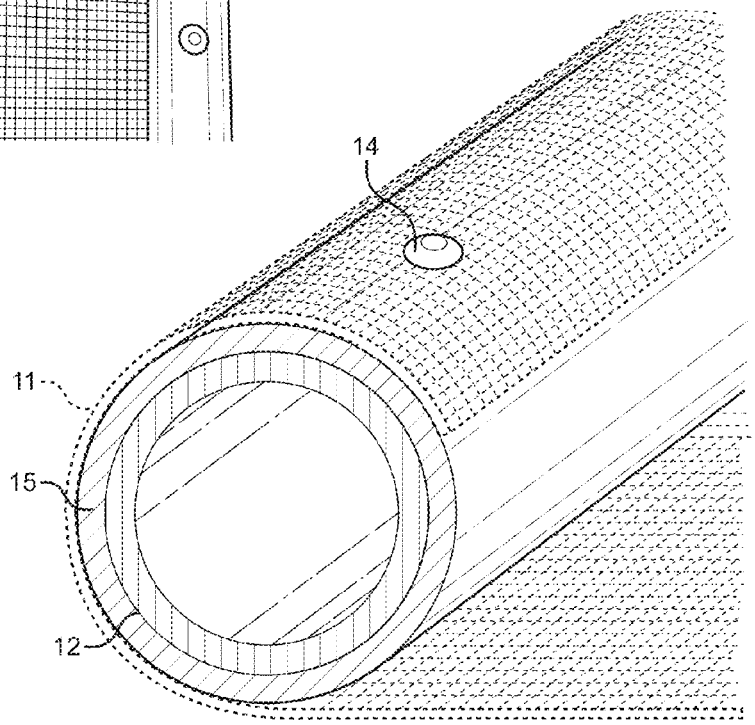
FIG. 3 shows an end view of the preferred construction of the microplastic removal tool of the present invention.

Referring now to FIG. 3, there is shown the preferred embodiment of the construction of the present invention. In this construction, the pole members 12 are hollow structures having an open interior and a rounded geometry. The exterior surface of the pole members 12 are optionally surrounded by a coextensive layer of wrapping material 15, which is preferably a layered tape material wound therearound or a padding material that is compressible and adds elasticity between the fasteners 14 and the mesh screen 11 connection points. The mesh screen 11 is positioned over the outer wrapping 15 and fastened thereto via discrete fasteners 14 along the pole member length. In one embodiment, the fasteners 14 are permanent fasteners in the form of pop rivets, which clamp down the mesh screen 11 and are spaced at an appropriate fastener pitch to prevent failures of these joints and any bunching of the mesh screen between the fastener locations.

Referring now to FIG. 4 and FIG. 5, there is shown an alternative construction of the present invention. In this construction embodiment, the pole members are solid members 22 having a rounded construction and a flat upper surface. The solid pole members 22 are optionally wrapped with the same wrapping material 15 and the mesh screen 11 is secured thereto by way of a series of fasteners driven into the pole members. However, a mounting plate 16 is positioned over the flat upper surface of the solid pole member 22, which is sandwiched between the fasteners and the solid pole member 22. The mesh screen is first stapled 18 to the solid pole member 22 along the pole member length and along the end of the mesh screen end, whereafter the mounting plate 16 is positioned thereover. Screw type fasteners 17, or alternative pop rivets, are driven through fastener apertures in the mounting plate 16 and into the solid pole member 22. Further contemplated is a hybrid of the first and second construction, wherein the hollow pole member comprises a flat upper surface and the mounting plate 16. All of these construction design have been proven useful in the use of the tool to support the load of sand positioned on the screen and suspended between the opposing pole members, while reducing failures of the screen at the fastener locations and thus reducing replacement costs or costs of repair.

Figure 6:
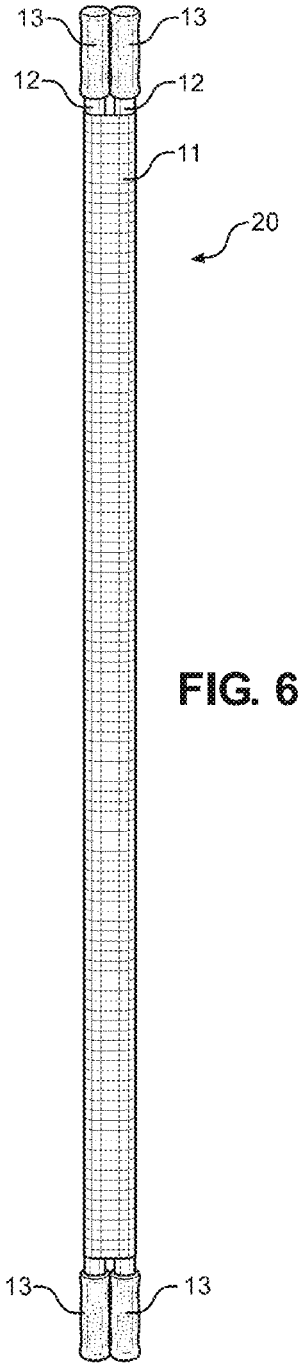
FIG. 6 shows a view of the microplastic removal tool in a stowed state.

Referring now to FIG. 6, there is shown a view of the present invention in a stowed state 20. When the tool is not in use, the two pole members 12 are rolled together so as to wrap the mesh screen 11 around the pair of pole members 12 and reduce the overall width of the assembly. The tool can then be supported by either handle end 13 thereof and placed in a storage location for later deployment. The ability to condense into a stowed state reduces storage location needs and prevents the mesh screen from becoming damaged between uses, which could impair its ability to effectively sift the sand material if the mesh size is altered or a penetration is created therethrough.

Figure 7:
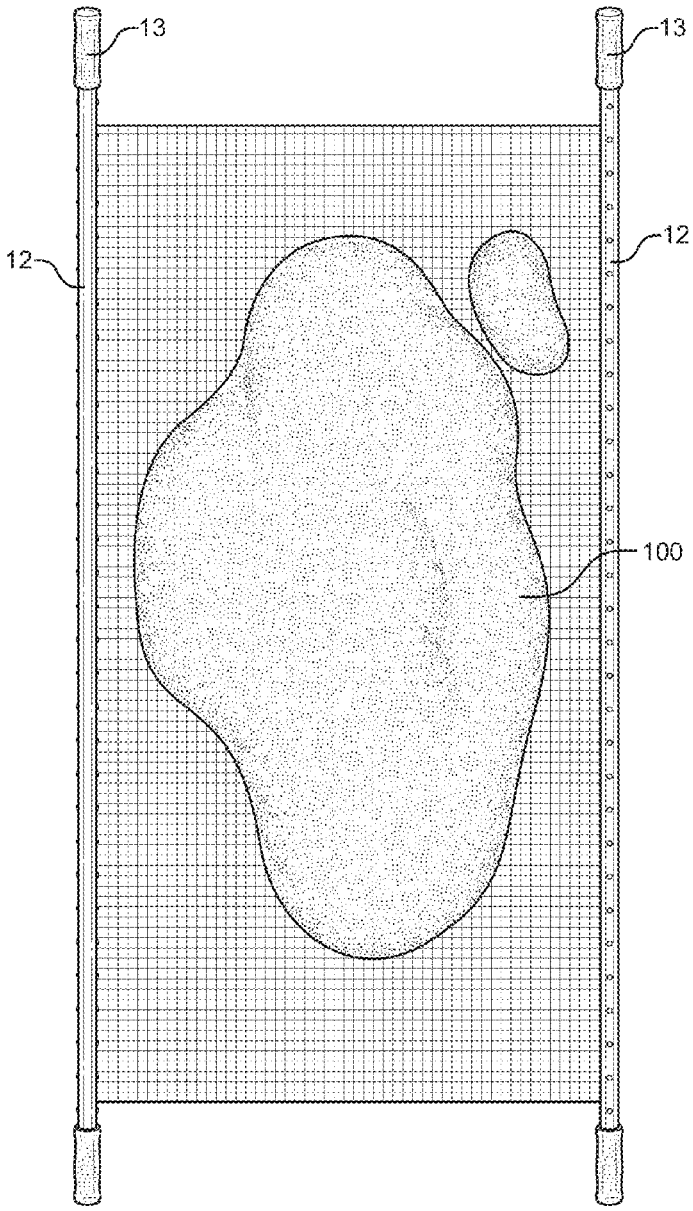
FIG. 7 shows a view of the microplastic removal tool in a working state, sifting microplastic affected sand to separate the microplastic therefrom.

Referring finally to FIG. 7, there is shown an overhead view of the microplastic removal tool of the present invention in a working state. While in use, the tool is unraveled and the mesh screen is placed in an open state as shown. The pole members 12 are placed on the ground adjacent to an affected area of sand to be treated. Workers utilize shovels and other hand tools to skim the sand surface, removing a layer of sand, along with the microplastic particles that have deposited thereon. This is generally confined to a meter wide band of affected sand as a result of the tides and the ocean waves. The affected sand 100 skimmed form the beach is placed on the screen mesh. After placement, a first and second worker support the opposing pole members 12 via their handled ends 13, drawing the mesh screen taught therebetween. The tensioned screen is then shaken in-plane and between the two workers to assist the communication of sand 100 through the mesh screen apertures, while also developing an electrostatic charge between the microplastic particles and the screen.

As the sand is sifted, the microplastic particles rub against the polymer coating of the mesh screen, developing an attractive electrostatic charge that makes the particles attracted thereto and cling to the screen as the sand falls to the beach surface. Once the sand has been communicated through the screen, the microplastic material is visible on the screen and is accumulated thereagainst apart from its sand substrate. The tool is then cleaned of the microplastic particles by wiping down the mesh screen or scraping the particles into a receptacle. The polymer coating of the mesh screen is preferably a polyurethane polymer coating, which when rubbed against other plastic particles develops an electrostatic charge, used as the vehicle for separating the sand therefrom.

Microplastics typically contain a large number of organic micro-pollutants and persistent organic pollutants. These pollutants are harmful to humans, as well as all marine and aquatic wildlife. Currently, there is no inexpensive way to remove minute microplastic particles from beach sand after it has been deposited and accumulated thereon. The present invention provides a manual tool that allows two-man teams to remove microplastic particles from beach sand using a sifting process. The device comprises of a mesh screen having an electrostatic charge with respect to the microplastic particles. The mesh screen is used to separate embedded marine plastics and other discarded items from the beach as sand communicates freely through the screen as the device is tensioned and shuffled between two users. As a result of the electrostatic charge, even very small and otherwise impossible-to-separate foreign plastic material is captured. This removes embedded marine plastic debris fragments and microplastics from beach sand, preventing birds, fish, and other ocean wildlife from ingesting toxic particles, and eliminates the chance of fish and other marine animals passing on the harmful plastic toxins to humans through the food chain cycle. The tool is particularly suited for commercial use along beachfront properties, for ecological cleanup use by different groups and agencies, and finally for personal use for those cleaning a local area having affected sand.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A microplastic removal tool, comprising:

an elongated mesh screen having a first and second mesh screen end and an end length;

said mesh screen comprising a wire mesh construction with a mesh aperture size;

said wire screen being coated with a polymer material thereover;

an elongated first and second pole member having a pole length and a first and second pole end;

said mesh screen being supported between said first and second pole member and said first and second mesh screen end being attached to said first and second pole member;

said polymer material of said wire screen adapted to develop an electrostatic charge when rubbed against plastic material in a sand substrate.

2. The microplastic removal tool of claim 1, wherein said first and second pole members further comprise:

a rounded, open member having an outer surface;

a plurality of fasteners along said pole length and through said open member for securing said mesh screen end thereto.

3. The microplastic removal tool of claim 2, wherein:

said outer surface being covered by a wrapping material;

said wrapping material being sandwiched between said fasteners and said open member.

4. The microplastic removal tool of claim 2, wherein said fasteners further comprise pop rivet fasteners.

5. The microplastic removal tool of claim 2, wherein said fasteners further comprise screw type fasteners and staple fasteners.

6. The microplastic removal tool of claim 1, wherein said first and second pole members further comprise:

a rounded, solid member having an outer surface and a flat upper surface;

a mounting plate along said flat upper surface;

said mesh screen end being sandwiched between said mounting plate and said solid member;

a plurality of fasteners along said pole length and through said mounting plate and said solid member for securing said mesh screen end thereto.

7. The microplastic removal tool of claim 6, wherein:

said outer surface and said flat upper surface are covered by a wrapping material;

said wrapping material being sandwiched between said mounting plate and said solid member.

8. The microplastic removal tool of claim 6, wherein said fasteners further comprise pop rivet fasteners.

9. The microplastic removal tool of claim 6, wherein said fasteners further comprise screw type fasteners and staple fasteners.

10. The microplastic removal tool of claim 1, wherein said pole length is greater than the length of said mesh screen end to form handle ends.

11. The microplastic removal tool of claim 1, wherein said handle ends further comprise handle grip covers thereover.

* * * * *